United States Patent [19]

Takahashi et al.

[11] 4,137,537

[45] Jan. 30, 1979

[54] ELECTROSTATIC TRANSFER PROCESS AND APPARATUS FOR CARRYING OUT THE SAME

[75] Inventors: Hideo Takahashi, Yokohama; Kazuhisa Aikawa, Zushi; Masakatsu Horie, Atsugi, all of Japan

[73] Assignee: Fujitsu Limited, Japan

[21] Appl. No.: 859,870

[22] Filed: Dec. 12, 1977

[30] Foreign Application Priority Data

Dec. 13, 1976 [JP] Japan ..... 51-149982

[51] Int. Cl.[2] ..... G03G 15/052

[52] U.S. Cl. ..... 346/159; 346/153

[58] Field of Search ..... 346/153, 157, 159, 160; 118/644

[56] References Cited

U.S. PATENT DOCUMENTS

| | | | |
|---|---|---|---|
| 3,045,587 | 7/1962 | Schwertz | 346/153 |
| 3,178,718 | 4/1965 | Baron | 346/153 |
| 3,484,792 | 12/1969 | Gold | 346/153 |
| 3,582,206 | 6/1971 | Burdige | 346/159 |
| 3,930,257 | 12/1975 | Quang et al. | 346/153 |
| 3,946,401 | 3/1976 | Young | 346/153 |
| 4,016,813 | 4/1977 | Pressman | 346/159 |

*Primary Examiner*—Jay P. Lucas

*Attorney, Agent, or Firm*—Staas & Halsey

[57] ABSTRACT

An electrostatic transfer process and apparatus for transferring an image comprised of letters, symbols and patterns onto a sheet of plain recording paper from an electrostatic latent image forming material comprised of a conductive substrate and an insulating layer formed on the substrate. The insulating layer surface of the electrostatic latent image forming material is uniformly charged with electrostatic charges. The charges of only image forming areas of the insulating layer surface are subsequently erased so that an electrostatic latent image is formed in the image forming areas. Thereafter, the electrostatic latent image forming material moves past a developing electrode to which is applied a voltage of the same polarity as that of the charges applied to the insulating layer of the electrostatic latent image forming material. Simultaneously, a developer having a charge of the same polarity as that of the voltage applied to the developing electrode is supplied to the image forming areas of the insulating layer surface to allow the developer to adhere to the area wherein the charges have been removed or diminished. Thus, the latent image is visualized. The resultant visualized image is transferred onto a sheet of plain paper for obtaining a clear recorded image.

16 Claims, 21 Drawing Figures

ELECTROSTATIC TRANSFER PROCESS AND APPARATUS FOR CARRYING OUT THE SAME

FIELD OF THE INVENTION

The present invention relates to a process of and an apparatus for carrying out electrostatic transferring in an electrostatic recording or printing apparatus connected as an output device to a data processing machine.

DESCRIPTION OF THE PRIOR ART

Conventional impact-type printing apparatus include many mechanical elements in the printing mechanism thereof; therefore, none of them are satisfactory with respect to the printing speed when used as output devices of data processing machines where the processing speed is being enhanced to a very high level.

Accordingly, in recently developed apparatus of this type the impact-system is not adopted in order to enhance the printing speed. Furthermore, as the printing speed is enhanced, the quantity of recording papers to be used is increased. Accordingly, if the running cost, which has heretofore been neglected, is taken into consideration, use of plain papers instead of expensive special papers, such as electrostatic recording papers and photosensitive papers, is preferred for high speed printers.

Furthermore, as the printing speed is enhanced with improvements made in data processing machines, the time allowable for the respective steps of latent image formation, development, transfer and cleaning in a printing apparatus having a limited capacity are inevitably shortened. Accordingly, in the case of a known printing apparatus in which an electrostatic latent image is formed by applying charges corresponding to letters or symbols to a chargeless electrostatic latent image forming material, if the peripheral speed of the electrostatic latent image forming material exceeds 0.7 m/sec, not enough time is provided for development and the print density is reduced, thus resulting in a disadvantage in that the print quality of a hard copy is drastically degraded. Furthermore, in a printer of the transfer system using plain paper, since the electrostatic latent image forming material is used again after the transfer, it is necessary to remove charges completely from the surface of the electrostatic latent image forming material after the transfer. More specifically, when charges of a polarity opposite to the polarity of the toner are present in the non-visualized areas, the toner adheres to the non-visualized areas on which the toner should not be applied, therefore, undesirable phenomena such as offset and contamination of the background are caused and prints having a good contrast cannot be obtained. Accordingly, the above-mentioned removal of the charges is necessary.

As a simple charge-removing method customarily adopted in the art, there can be mentioned a method in which residual charges are neutralized and removed by charges of alternating current corona discharge. According to this method, it is necessary to adjust the densities of corona charges of the positive polarity and the densities of corona charges of the negative polarity to substantially equivalent levels and to increase the frequency of an alternating current high voltage to be applied with increase of the rotation speed of the electrostatic latent image forming material. Therefore, the adjustment operations become very difficult and complete removal of charges cannot be expected when the rotation speed of the electrostatic latent image forming material is enhanced with enhancement of the recording speed. There can also be mentioned a method in which charges are removed by contacting an earthed conductor with the surface of the electrostatic latent image forming material. This method, however, cannot be put into practical application because mechanical damages of the surface of the electrostatic latent image forming material are serious. Furthermore, there can be mentioned a method in which charges are removed by using a conductive liquid. This method, however, is defective in that additional devices should be disposed for supplying or preparing such a conductive liquid, thus resulting in increases in the dimensions of the printing apparatus and in the manufacturing cost of the printing apparatus.

SUMMARY OF THE INVENTION

It is a primary object of the present invention to provide an electrostatic transfer system in which high speed printing is possible and a clear image can be recorded.

Another object of the present invention is to provide an electrostatic transfer system in which printing can be performed repeatedly without removing charges from an electrostatic latent image forming material and prints of high quality can be obtained.

A still another object of the present invention is to provide an electrostatic transfer system in which both the running cost and the manufacturing cost can be remarkably reduced.

A further object of the present invention is to provide an electrostatic transfer apparatus in which electrostatic latent images wherein expansion of the dot diameter can be controlled even without maintaining the distance between a recording head and the surface of an electrostatic latent image forming material with high accuracy.

A still further object of the present invention is to provide an electrostatic transfer apparatus, which is provided with a residual developer (toner) removing device by which the residual developer (toner) adhering on the surface of an electrostatic latent image forming material can be recovered at high efficiency after the transfer step, and scattering of the developer (toner) can be effectively prevented.

Another still further object of the present invention is to provide an electrostatic transfer apparatus in which multi-color prints can be reproduced from one latent image forming zone by conducting the operation of writing a static image only one.

DETAILED DESCRIPTION OF PREFERRED EMBODIMENTS

Figure 1:
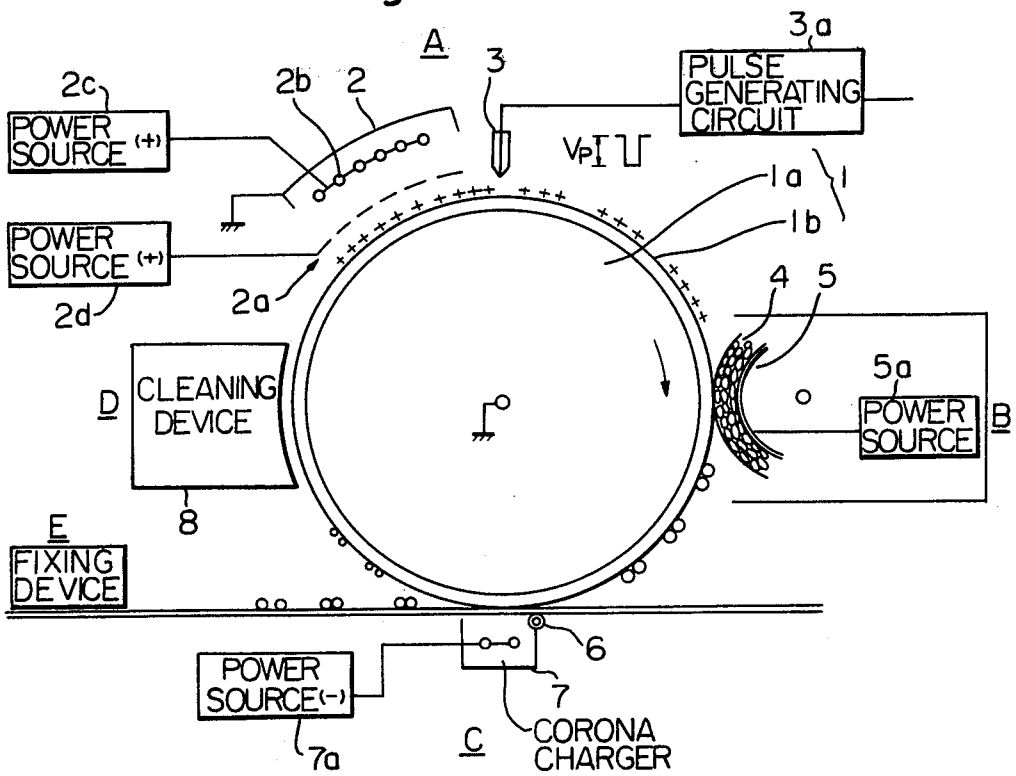
FIG. 1 is a schematic view of the entire arrangement of an electrostatic transfer apparatus according to the present invention.

In FIG. 1, A represents an electrostatic latent image forming zone, B a developing zone, C a transfer zone, D a cleaning zone, and E represents a fixing zone. An electrostatic latent image forming material 1 comprises a cylindrical conductive substrate 1*a* and an insulating layer 1*b* disposed thereon. The electrostatic latent image forming zone A comprises a corona charger 2 including a control electrode 2*a*, a corona electrode 2*b*, a power source 2*c* for the corona electrode and a power source 2*d* for the control electrode, and a pin electrode 3 connected to a circuit 3*a* for generating pulses to be applied to the pin electrode 3. The developing zone B comprises a coloring toner 4 as the developer and a developing electrode 5 connected to a power source 5*a* for the developing electrodes. The transfer zone C comprises a guide roller 6 and a transfer corona charger 7 connected to a power source 7*a* for the corona electrode. The cleaning zone D comprises a cleaning device 8 including a residual toner scraping brush such as a fur brush. The fixing zone E comprises a known fixing device such as a heating roller or an infrared heater.

The operation of the electrostatic transfer apparatus having the above-mentioned arrangement will now be described.

For formation of a latent image, at first, a predetermined electric voltage Vs' is applied to the control electrode 2*a* of the corona charger 2. This voltage Vs' is adjusted so as to be substantially equal to the surface voltage Vs of the insulating layer 1*b* necessary for formation of a latent image, and the polarity of the voltage Vs' is maintained the same as the polarity of the surface voltage Vs (the positive polarity in the drawing). Simultaneously with the application of the voltage Vs', a corona discharge voltage (Vc = 6 KV to 8 KV) (the positive polarity in the drawing) is applied to the corona electrode 2*b* of the corona charger 2, whereby the surface of the insulating layer 1*b* of the latent image forming material 1 moving below the corona charger 2 is uniformly charged with the electric voltage Vs. When the charged area arrives below the top end of the pin electrode 3 which is not contacted with the surface of the insulating layer 1*b* of the latent image forming material 1, a pulsating voltage Vp of a polarity opposite to the polarity of the voltage Vs which is related to dots formed by decomposition of letters, symbols or the like is applied to the pin electrode 3. By the electric discharge generated at this stage, charges on the charged area of the insulating layer 1*b* of the latent image forming material 1 are removed or diminished, whereby the voltage difference (the difference of the electric field intensities) corresponding to the dots is produced and an electrostatic latent image is formed (see FIG. 2).

In the above process for forming an electrostatic latent image, the voltages Vs and Vp should satisfy the following condition:

$$|Vs - Vp| > Vd$$

wherein Vd stands for the discharge initiating voltage which varies depending on such factors as the gap between the pin electrode 3 and the latent image forming material 1.

As will readily be understood from these condition, formation of a latent image depends not only on the voltage Vp applied to the pin electrode 3 but also on the charging voltage Vs on the surface of the electrostatic latent image forming material. This fact will now be described in detail with reference to FIGS. 2 and 3.

Figure 2:
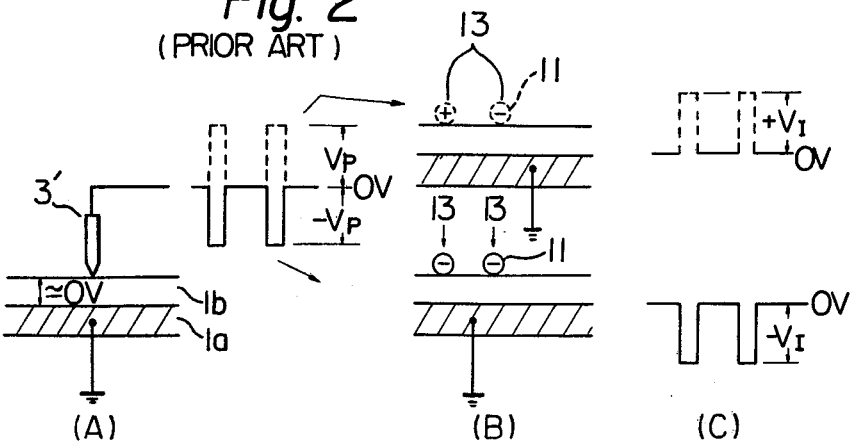
Fig. 2 (PRIOR ART)
FIG. 2 is a diagram illustrating the conventional process for forming latent images.

In the conventional process for forming latent images, in the state where a pin electrode 3' is contacted with the surface of a non-charged electrostatic recording paper which also acts as a latent image forming material and comprises a conductive substrate 1*a* and an insulating layer 1*b*, as shown in FIG. 2-(A), pulsating voltages closely related to dots are applied to the pin electrode 3'. In FIG. 2, the positive pulsating voltage Vp is indicated by broken lines and the negative pulsating voltage-Vp is indicated by solid lines. FIG. 2-(B) is a view diagrammatically illustrating latent image charges formed on the latent image forming material, and FIG. 2-(C) shows the surface potential of the latent image forming material. As will be apparent from these FIGS. 2-(A), 2-(B) and 2-(C), in the conventional process, electric charges 11 are applied to an area 13 to be visualized on the surface of the non-charged latent image forming material by means of the pin electrode, and these charges 11 are directly used for forming a latent image. Accordingly, in the conventional process, formation of a latent image depends directly on the pulsating voltage Vp applied by the pin electrode 3'.

Figure 3:
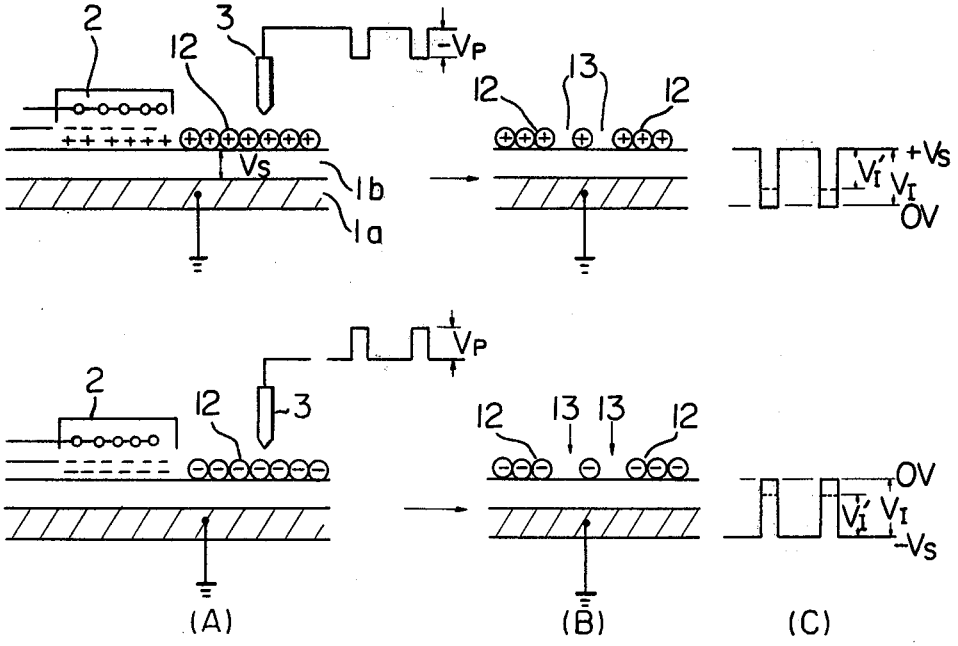
FIG. 3 is a diagram illustrating the process for forming latent images according to the present invention.

Though not specifically illustrated in the drawing, there can be mentioned another known latent image forming process in which an electrode is disposed on the back side of an electrostatic recording paper. An electric discharge is caused by a voltage applied to this electrode, and the voltage Vp applied by the above-mentioned pin electrode and electric charges generated by the discharge are supplied to the electrostatic recording paper. For the reasons described hereinafter, however, this process is substantially different from the latent image forming process of the present invention. As described hereinbefore, in the conventional process, electric charges generated by an electric discharge are supplied to the surface of an electrostatic latent image forming material and are directly used for formation of a latent image. In contrast, according to the process of the present invention, electric charges on the already charged surface of the static image forming material are diminished or removed by electric charges generated by an electric discharge between the surface of the latent image forming material and the pin electrode, and the area in which the charges are thus removed or diminished is caused to be visualized. FIGS. 3-(A) through 3-(C) correspond to FIGS. 2-(A) through 2-(C), respectively. In FIGS. 3-(A) through 3-(C), reference numeral 12 represents already applied charges on the latent image forming material charged by the corona charger 2. In FIG. 3-(C), $V_1$ represents the surface potential of the latent image-forming area, where already applied charges 12 are not completely removed. As will be apparent from a comparison of FIG. 3 with FIG. 2, the conventional process is based on a charge-supplying process, while the process of the present invention is based on a charge-erasing process.

Various characteristics of the present invention attained by adoption of the charge-erasing process will now be described with reference to experimental data.

A first advantage of the charge-erasing process is that pulsating voltages applied by the pin electrode can be reduced without provision of a back face electrode or the like.

Figure 4:
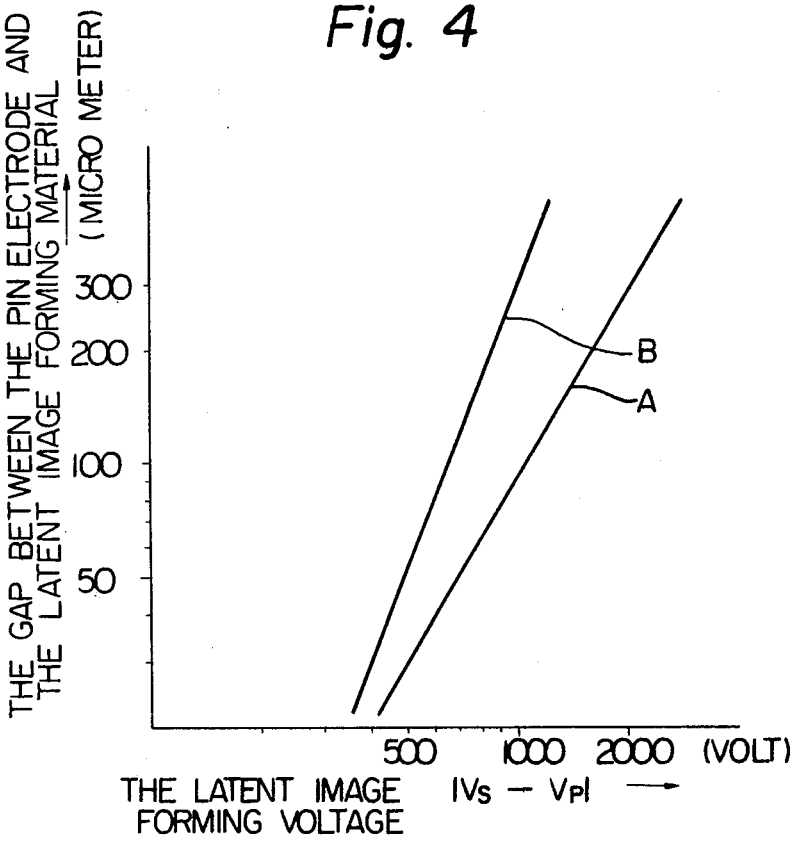
FIG. 4 is a graph illustrating the relation between a latent image forming voltage and a gap between a pin electrode and a latent image forming material.

FIG. 4 is a graph illustrating the relation between the latent image forming voltage and the gap between the pin electrode and the latent image forming material. In FIG. 4, the abscissa indicates the latent image forming voltage and the ordinate indicates the gap. As is seen from the graph of FIG. 4, in the process of the present invention, the latent image forming voltage [$|Vs - Vp|$] is much lower than in the conventional process, when the comparison is made based on the same gap. More specifically, in the conventional process, since the surface potential Vs of the latent image forming material is substantially zero [$Vs \approx ov$], all the voltage necessary for formation of a latent image is borne by the pulsating voltage Vp applied by the pin electrode. For example, when the gap is about 50 micrometers, in the conventional charge-supplying process (line A in the drawing), it is necessary to apply a voltage of 700 volts. In contrast, in the charge-erasing process of the present invention (line B in the drawing), a voltage of about 500 volts is sufficient. Moreover, this voltage can be borne by both the voltage Vp applied by the pin electrode and the surface voltage Vs of the latent image forming material. Suppose that the voltage is equally borne by Vp and Vs, each of Vp and Vs may be 250 volts or lower. Accordingly, the pulsating voltage Vp applied by the pin voltage can be reduced to $\frac{1}{2}$ to $\frac{1}{3}$ of the pulsating voltage necessary in the conventional process.

This results in various advantages. For example, commercially available cheap transistors can be used as transistors of a circuit for driving the pin electrode. Accordingly, the designing and manufacturing of the driving circuit can be remarkably facilitated. Moreover, even if pin electrodes are arranged at a high density, leakage of the voltage between two adjacent pin electrodes can be remarkably reduced and a good insulation strength can be attained. Accordingly, prints of high quality can be obtained.

A second advantage is that reduction in the development density of an electrostatic latent image can be prevented even though the time interval permitted for developing the image is decreased due to a recent increase in the moving speed of the electrostatic latent image forming material, which increase is accompanied by an enhancement of the printing speed of a recent conventional electrostatic recording apparatus. As will be apparent from FIG. 1, in the case of high speed printing, namely when the electrostatic latent image forming material 1 is rotated (moved) at a high speed, the time allowable for the development in an apparatus having a limited capacity should inevitably be shortened. Thus, when the peripheral speed of the latent image forming material is as high as, for example, 1 m/sec, the print density is reduced due to insufficient development time.

Figure 5:
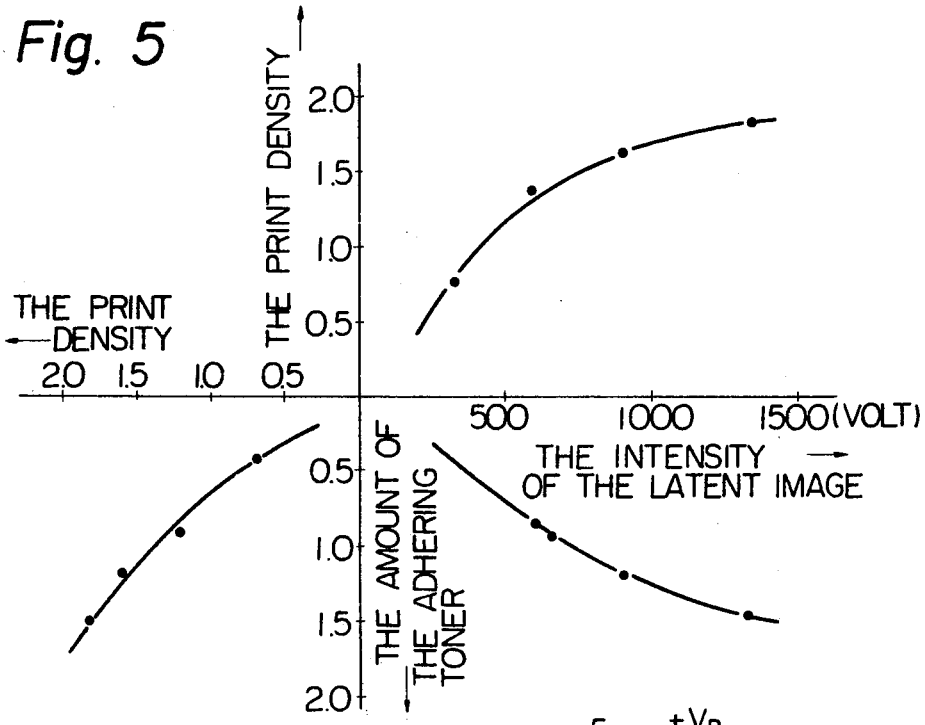
FIG. 5 is a graph illustrating the relation among the intensity of a latent image, the density of a print and the amount of an adhering toner.

FIG. 5 is a graph illustrating the relation among the intensity of the latent image, namely the difference of the voltages between the area to be visualized and the non-visualized area, the print density after transfer onto plain paper and the amount of the adhering toner in the customary electrostatic recording apparatus. As is seen from this graph, the print density is determined by the intensity of the latent image and the amount of the toner adhering to the latent image per unit time.

In the present invention, by adopting the charge-erasing process instead of the conventional charge-supplying process, reduction of the print density owing to enhancement of the printing speed can be prevented very simply.

Figure 6:
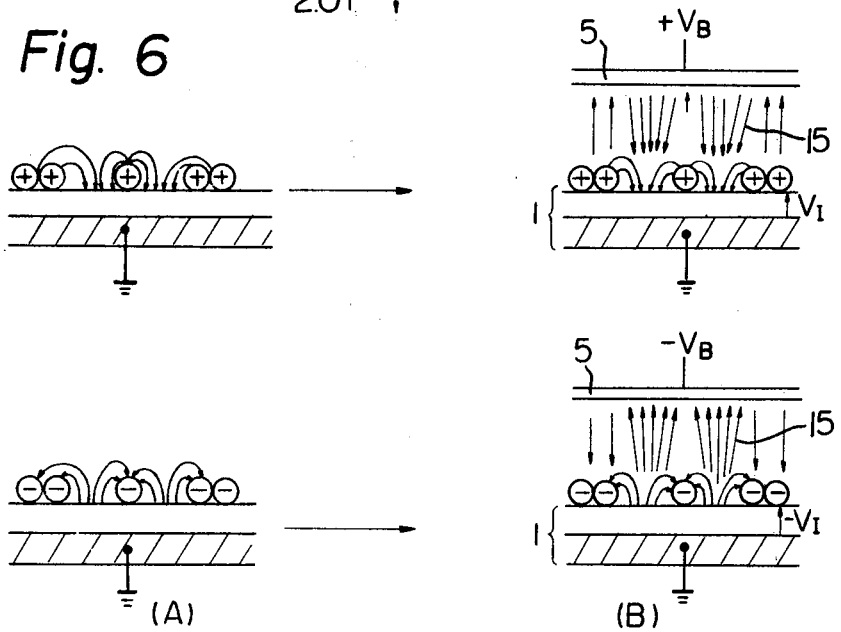
FIG. 6 is a diagram illustrating the electric field in a developing zone according to the present invention.

More specifically, in the present invention, as shown in FIG. 6, in the developing zone a developing electrode 5 is disposed adjacent to the latent image forming material 1 (FIG. 1) on which a latent image has been formed. An electric voltage Vs of the same polarity as that of the charges already applied to the surface of the latent image forming material, which voltage is slightly lower than the voltage Vs of these surface charges, is applied to the developing electrode 5. As a result, the electric force line from the developing electrode becomes more intensely concentrated on the charge-removed area to be visualized than in the case where no developing electrode is employed at all, as shown in FIG. 6-(A), and the intensity of the electric field for attracting the toner is remarkably enhanced. In this state, if a toner 4 of the same polarity as that of the already applied charges of the non-visualized area is supplied between the developing electrode and the latent image forming material, by the action of the above-mentioned electric field the toner is caused to adhere to the surface of the latent image forming material in the charge-removed area to be visualized, and a visible image is thus formed. By adopting this latent image forming process in which charges are removed from the areas to be visualized, the amount of the adhering toner can be controlled by the voltage VB applied to the developing electrode 5. Accordingly, it becomes possible to compensate the reduction of the print density caused by enhancement of the printing speed by decreasing the amount of the adhering toner.

Furthermore, unnecessary adhesion of the toner to a non-visualized area can be prevented in this charge-erasing latent image forming process; therefore, prints of good contrast free of background contamination can be obtained. The reason is that if the relation of $|V_I| \cdot \geqq |V_B|$ is maintained, as is apparent from FIG. 6-(b), then the electric field 15 in the non-visualized area is caused to have a polarity reverse to that of the area to be visualized, and the toner is repelled by the non-visualized area and not allowed to adhere to the non-visualized area.

Figure 7:
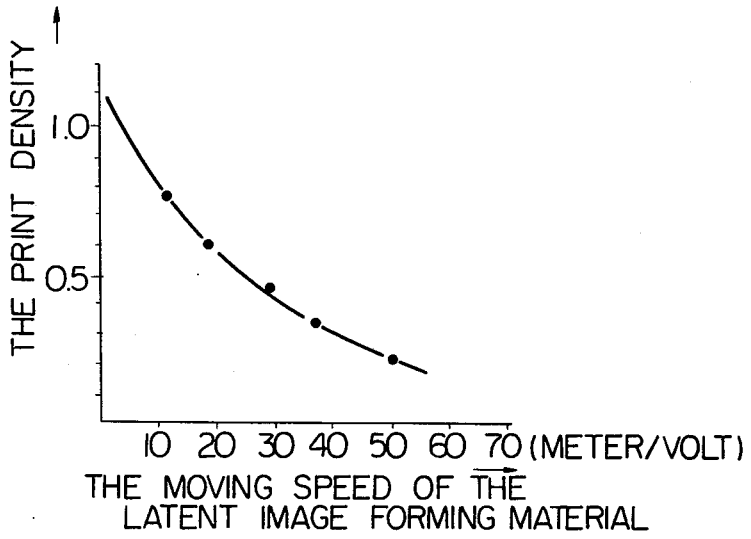
FIG. 7 is a graph illustrating the relation between the speed of a latent image forming material and the print density.
Figure 8:
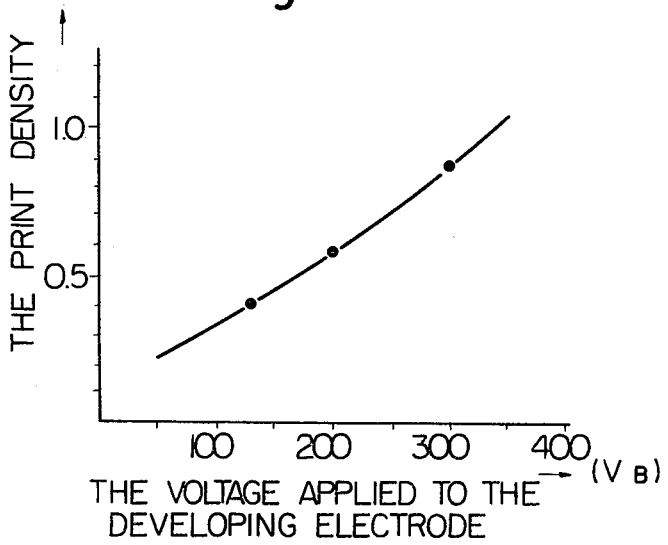
FIG. 8 is a graph illustrating the relation between the voltage to be applied to a developing electrode according to the present invention and the print density.

As pointed out hereinbefore, according to the electrostatic latent image forming process of the present invention, reduction of the print density due to enhancement of the recording speed by decreasing the amount of the adhering toner can be effectively compensated. Experimental results providing this fact are illustrated in the graphs in FIGS. 7 and 8. The graph of FIG. 7 illustrates the relation between the moving speed of the latent image forming material and the print density, which is observed when the voltage applied to the developing electrode is relatively low ($V_B$=100 V). As is seen from this graph, the print density is remarkably reduced with enhancement of the moving speed of the latent image forming material. The graph of FIG. 8 illustrates the relation between the voltage applied to the developing electrode and the print density. As is seen from the graph of FIG. 8, by increasing the voltage $V_B$ applied to the developing electrode, the print density can be easily elevated. For example, in the electrostatic transfer apparatus of the present invention, it is very easy to obtain a practically applicable print density of at least 0.7.

A third characteristic advantage of the present invention is that continuous use of a latent image forming material including an insulating layer having no photosensitive characteristics, which has heretofore been regarded as being impossible, is made possible without any particular charge-removing step. In the conventional charge-supplying process, as will readily be understood from FIG. 2 and the illustration given hereinbefore with reference to FIG. 2, in order to prevent adhesion of the toner to the non-visualized area, it is indispensable to reduce the surface voltage of the non-visualized area of the image forming material to zero volt or to such a low level as will not allow adhesion of the toner. In order to prevent offset by removing the latent image formed at the preceding recording operation, it is also indispensable to remove charges from the latent image forming material prior to initiation of formation of a latent image. It is practically impossible to completely remove charges from an insulating layer. Accordingly, in the conventional electrostatic recording apparatus, a latent image forming material that is not repeatedly used, for example, an electrostatic recording paper, is used as the latent image forming material, or charge removal is performed by utilizing a particular property of a photosensitive layer wherein the electric resistance is lowered if the entire surface is exposed to actinic rays. The photosensitive layer readily undergoes mechanical damages and its life is extremely short. In addition, it is very expensive to produce a latent image forming material having the photosensitive layer. Accordingly, various attempts have heretofore been made to completely remove charges on the surface of a latent image forming material including only an insulating layer to reduce the surface voltage of such a latent image forming material substantially to zero volt. However, no satisfactory means which can satisfy preferred practical requirements and conditions has been developed.

With such background in mind, we experimented and succeeded in overcoming the above difficulty by adopting the above-mentioned charge-erasing type latent image forming process.

Figure 9:
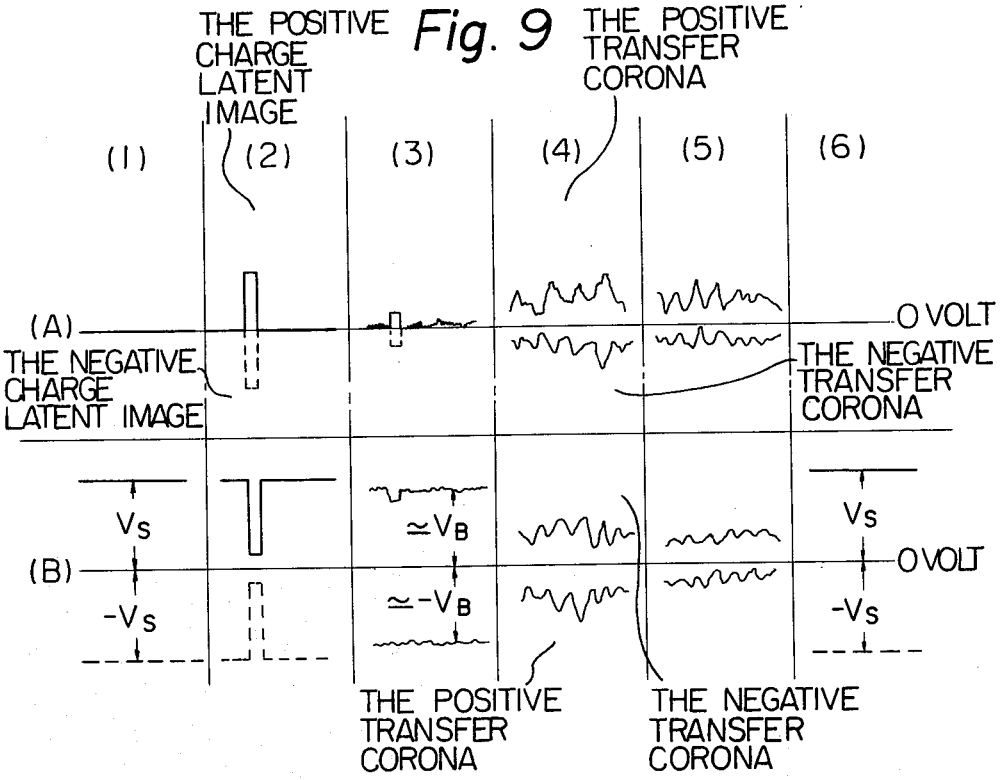
FIG. 9 is a diagram illustrating the surface potentials of the latent image forming material in the conventional latent image forming process and in the latent image forming process of the present invention.

FIG. 9 illustrates surface voltages on the latent image forming material at the latent image forming step in either the conventional charge-supplying process or the charge-erasing process of the present invention. FIG. 9-(A) shows the conventional latent image forming process and FIG. 9-(B) shows the latent image forming process of the present invention, in which (1), (2), (3), (4) and (5) represent the surface voltages of the latent image forming material before formation of a latent image, after formation of a latent image, after development, after transfer and after cleaning, respectively. As is seen from the drawing, in the conventional process shown in FIG. 9-(A), it is necessary to reduce the voltage (5) after the cleaning step to such a low level as will not allow adhesion of the toner, preferably substantially to zero volt. However, in the process of the present invention shown in FIG. 9-(B), such reduction of the surface voltage is unnecessary, and only the surface voltage of the latent image forming material is maintained again at a level Vs necessary for formation of a latent image.

Figure 10:
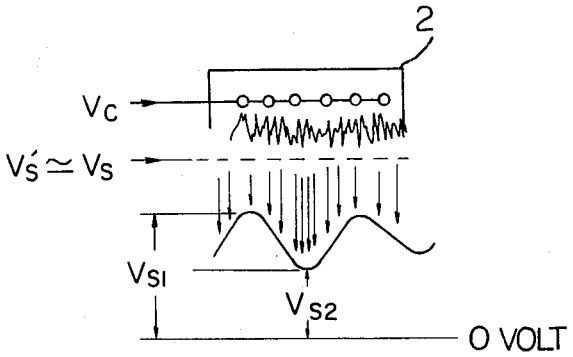
FIG. 10 is a diagram illustrating the surface potential of the latent image forming material prior to the latent image process according to the present invention.
Figure 11:
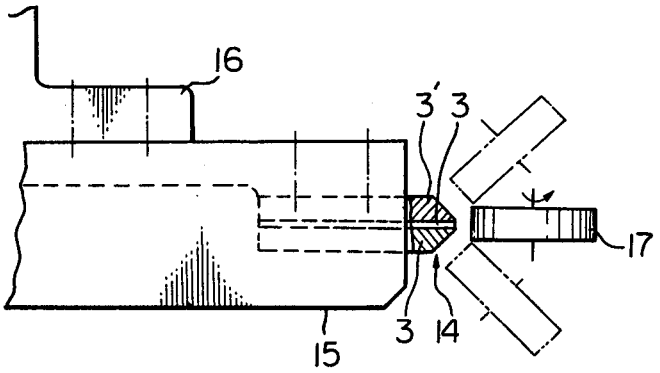
FIGS. 11 to 14 are views illustrating methods of setting a latent image forming electrode.
Figure 12:
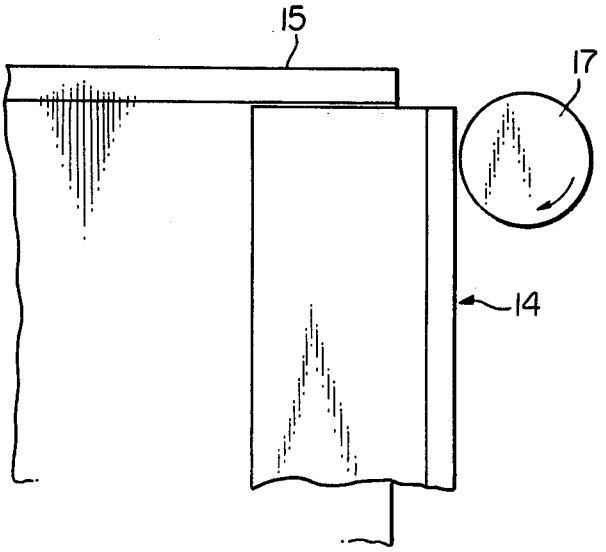

FIG. 10 is a diagram illustrating the relation between the intensity of the electric field generated by a corona charger for formation of a latent image, which maintains the surface of the latent image forming material after the cleaning step uniformly at a voltage Vs necessary for the next cycle, and the surface voltage of the image forming material. After the cleaning step, the surface of the latent image forming material is irregularly charged. When this non-uniformly charged surface of the latent image forming material arrives below the corona charger 2 having control electrodes, the intensity of the electric field between the control electrode and the surface of the insulating layer of the image forming material depends on the level of the surface voltage of the insulating layer. More specifically, in the high-voltage area Vs1 the intensity of the electric field is low, and in the low-voltage area Vs2 the intensity of the electric field is high. Accordingly, the density of charges radiating from the corona charger is low in the high electric field area and the density of radiating charges is high in the low electric field area. Accordingly, after the lapse of a certain length of time, the surface of the insulating layer is uniformly charged. Since this charge voltage is controlled by the voltage applied by the control electrode, if this voltage Vs' is maintained at a level of Vs'≃Vs, the charge voltage does not exceed Vs, such state (1) before formation of a latent image is restored being shown in FIG. 9. Namely, in the process of the present invention, complete removal of charges is unnecessary and continuous use of a latent image forming material including an insulating layer becomes possible.

FIGS. 11 to 14 illustrate methods of setting a latent image forming electrode which is a structural element of the electrostatic latent image forming zone A shown in FIG. 1.

Figure 13:
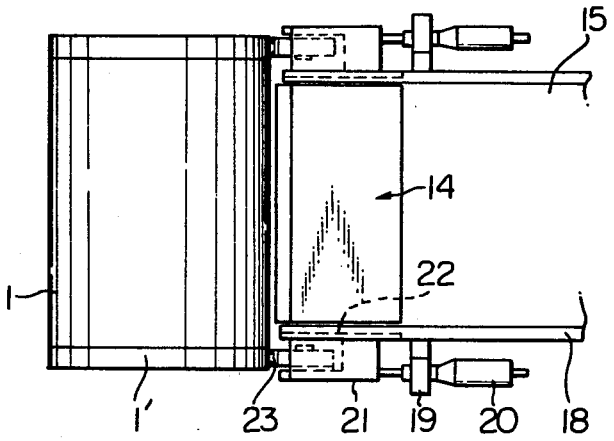
Figure 14:
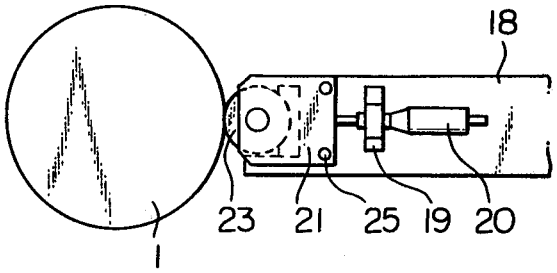

During setting of the latent image forming electrode 3, while a recording head is attached to a table on which a latent image forming material 1 is mounted, the recording head is polished to produce a high rectangularity in the recording head. Then, the table including the recording head mounted integrally therewith is moved to adjust the gap between the recording head and the latent image forming material. More specifically, at first a recording head 14 comprising a number of pin electrodes 3 gripped in a line between parts of a two-piece Bakelite resin component 3' is screwed to a table 15. In this state, the table 15 is attached to a polishing jig 16, and the top end of the recording head 14 is tapered and polished in a straight line by a grinder 17. Then, the table 15 provided with the recording head 14 is taken out from the polishing jig 16 and is attached to the side of a latent image forming material 1 (FIG. 1). The state where the recording head 14 is disposed adjacent to the latent image forming material is illustrated in FIGS. 13 to 14. As shown in the drawings, an arm 19 is projected from each of the two side plates 18 of the table 15, and a micrometer head 20 is attached to the arm 19. A holder 21 is movably attached to the top of the micrometer head 20 while the holder is fitted in a groove 22 formed on the side plate 18, and a guide roller 23 is mounted on the holder 21. While the guide roller 23 is in contact with the edge 1' of the latent image forming material 1, the table 15 having the recording head 14 is set at a position facing the latent image forming material 1. In this state, the table 15 is moved by the micrometer head 20 to approach to or separate from the latent image forming material 1, so that the gap between the pin electrodes 3 of the recording head 14 moving integrally with the table 15 and the latent image forming material 1 is adjusted to a predetermined value, for example, 30 micrometers. After the gap between the pin electrodes 3 and the latent image forming material 1 has thus been adjusted, the holder 21 is screwed to the table 15 and fixed by a knock pin 25 to prevent deviation of the fixed position. Thus, the pin electrodes 3 (FIG. 11) of the recording head 14 are fixed together with the table 15 and the setting operation is completed. In addition, if some appropriate rotatable cleaning brush is arranged adjacent to the electrostatic latent image forming material, and if the cleaning brush is arranged so that it is rotated by the material, wiping off of the toner which was adhered to the recording head 14 can be effectively achieved.

Figure 15:
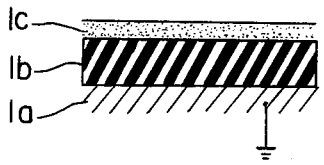
FIG. 15 is a schematic view illustrating another example of the structure of the latent image forming material which is applied to the electrostatic transfer apparatus according to the present invention.

Referring to FIG. 15, a latent image forming material includes a conductive substrate 1*a*, an undercoat layer 1*b* as the first dielectric layer and a recording layer 1*c* as the second dielectric layer. In the latent image forming material of this embodiment, a layer having a low electric capacity ($C_2$=50–100 pF/cm$^2$) and a medium electric resistivity ($\rho_2=10^6$–$10^9\Omega$-cm), and having a thickness of 30 to 80 micrometers is coated as the undercoat layer 1*b* on the conductive substrate 1*a*. A layer having a high electric capacity ($C_1$=200–500 pF/cm$^2$) and a thickness of 15–50 micrometers is coated as the recording layer 1*c* ($\rho_1=10^{12}$–$10^{15}\Omega$-cm), on which a latent image of charges is to be formed, on the undercoat layer 1*b*. Accordingly, the latent image forming material of this embodiment has a thus formed two-layer structure. In order to attain the above electric capacities in the respective layers, the specific inductivity ($\epsilon$ $r_2$) of the undercoat layer 1*b* is adjusted to about 4.0 and the specific inductivity ($\epsilon$ $r_1$) of the recording layer 1*c* is adjusted to about 7.0

For obtaining a material of the undercoat layer 1*b* having the above electric resistitity and specific inductivity, carbon or a metal oxide may be incorporated in an acrylic, epoxy or melamine resin. Furthermore, for obtaining a material of the recording layer 1*c* having the above electric resistivity and specific inductivity, titanium oxide or the like may be incorporated in an acrylic, epoxy or melamine resin to increase the electric capacity.

In the conventional electrostatic recording apparatus, so-called spots having an extraordinarily large diameter are often formed in a recorded image by changes of the bias voltage, applied pulsating voltage, recording atmosphere and other physical conditions; accordingly, the quality of recorded letters or symbols is drastically degraded by the presence of these spots. This embodiment relates to the latent image forming material and latent image forming process by which generation of these spots can be effectively prevented. As a result of our experiments, it was found that in the conventional electrostatic recording apparatus, spots are generated because during formation of a latent image, the latent image forming current is extraordinarily increased by an extraordinarily strong electric field generated in the gap between the latent image forming material and the pin electrode by changes of the above-mentioned various conditions. This extraordinarily strong current flows over a broad region on the recording layer. This state will now be described with reference to the drawings.

Figure 16:
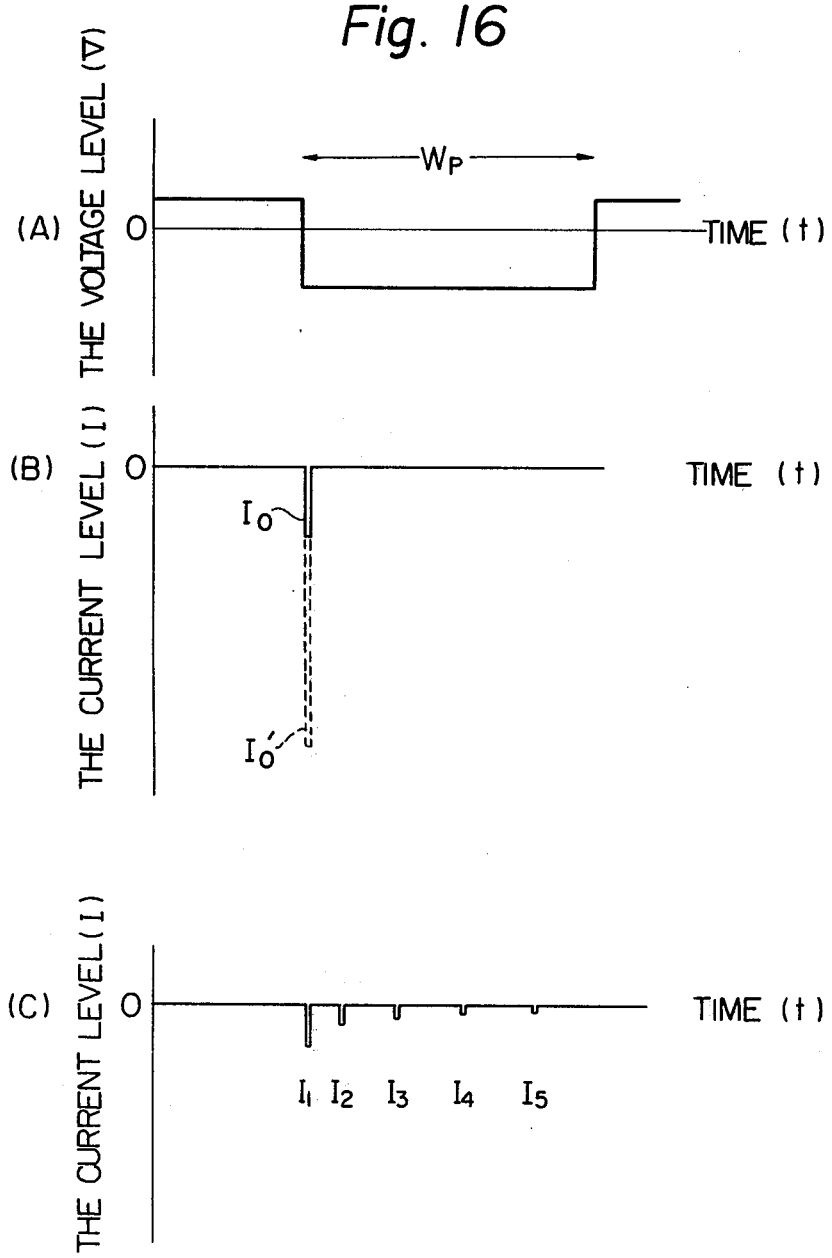
FIG. 16 is a diagram illustrating the latent image forming currents in the conventional process and in the process of the present invention.

FIG. 16 illustrates latent image forming currents caused to flow by discharge when a pulsating voltage is applied to the pin electrode in either the conventional process or the process of the present invention. FIG. 16-(A) illustrates a wave form of a pulsating voltage applied to the pin electrode; FIG. 16-(B) illustrates a latent image forming current corresponding to dots in the case of the conventional latent image forming material; and FIG. 16-(C) illustrates a latent image forming current related to dots in the case of the latent image forming material of the present invention.

In the case of the conventional latent image forming material, the latent image forming current is of a single-shot characteristic. That is, if an appropriate dot current is expressed as $I_0$, when a spot is generated, a large current $I'_0$ several times to scores of times as large as $I_0$ will flow in a short time. In contrast, when the latent image forming material of this embodiment including a resistant layer below the recording layer as shown in FIG. 15 is employed, several electric discharges are conducted with the pulse width Wp of the pulsating voltage being applied to the pin electrode as shown in FIG. 16-(C); hence, the latent image forming current is accordingly generated several time. Furthermore, the level of the latent image forming current is gradually reduced in the order of the first current, the second current, . . . and the n-th current. The present inventors noted this peculiar phenomenon and found that generation of a spot-causing abnormal current can be prevented from occurring if the requirement of $I_1+I_2+I_3 \ldots I_n \simeq I_0$ is satisfied.

Figure 17:
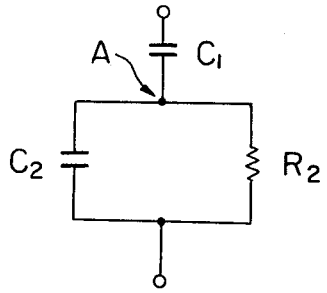
FIG. 17 is a view illustrating an equivalent electric circuit referred to in the structure of the latent image forming material shown in FIG. 15.

The reason why an electric discharge is caused several times when a latent image is formed by using the latent image forming material of FIG. 15 can be explained by referring to an equivalent electric circuit shown in FIG. 17. In FIG. 17, $C_1$ represents the electric capacity of the recording layer 1*c* in FIG. 15; $C_2$ represents the electric capacity of the undercoat layer 1*b* in FIG. 15; and $R_2$ represents the electric resistivity of the undercoat layer 1*b*. $C_1$, $C_2$ and $R_2$ corresponding to the above-mentioned specific inductivities and electric resistivity can be expressed as follows:

$$C_1 = \frac{\epsilon_0 \epsilon_{r1}}{d_1} \cdot S$$

$$C_2 = \frac{\epsilon_0 \epsilon_{r1}}{d_2} \cdot S$$

and $$R_2 = \rho_2 \cdot \frac{d_2}{S}$$

In the foregoing formulae, $d_2$ stands for the thickness of the undercoat layer; $d_1$ stands for the thickness of the recording layer; and S represents the area of the latent image forming region.

When driving voltage pulses satisfying the electric discharge conditions are applied to the pin electrodes, a discharge is initiated in the gap between the latent image forming material and the pin electrodes. The discharge current first flows into the capacity $C_1$ of the recording layer 1*c* and charges are accumulated. The same quantity of charges are accumulated in the capacity $C_2$ of the undercoat layer 1*b* by induction. As a result, the potential at point A shown in FIG. 17 is elevated. Accordingly, the gap voltage between the latent image forming material and the pin electrodes is reduced, maintenance of the electric discharge becomes impossible, and the discharge is stopped.

Then, the charges stored in $C_2$ are introduced at a time constant of $C_2R_2$ ($=\epsilon_0 \cdot \epsilon r_2 \cdot \rho_2$) through the resistance $R_2$ of the undercoat layer 1*b* into the earthed conductive substrate 1a, and the potential at point A in FIG. 17 is reduced again. Accordingly, the gap voltage is elevated again and when it is elevated to a discharge initiating level, a discharge occurs again. This phenomenon is repeated several times, and charges are accumulated in a predetermined region of the recording layer within a short time due to such repeated electric discharges. In the case of the so-called charge-erasing process where the recording layer is uniformly charged in advance and charges in a predetermined region are removed or diminished to form a latent image, by these repeated discharges, charges in the predetermined region can be removed or diminished within a short time. When the above-mentioned gap voltage no longer reaches the discharge initiating level, the discharge process is no longer conducted.

As will be apparent from the foregoing illustration, the essence of the current controlling effect at the latent image forming step resides in conducting electric discharge operations several times and reducing the level of the latent image forming current generated by one electric discharge. For attaining this feature, the following two requirements should be satisfied.

(1) $C_1$ (electric capacity of the recording layer) > $C_2$ (electric capacity of the undercoat layer):

When the electric capacity ($C_2$) of the undercoat layer is large, especially as large as or larger than the electric capacity ($C_1$) of the recording layer, the level of the latent image forming current flowing through the capacity ($C_2$) of the undercoat layer is increased and the effect of controlling the latent image forming current is lowered. Accordingly, the electric capacity ($C_2$) of the undercoat layer is determined after due consideration of the frequency of repetitions of the discharge, the appropriate latent image forming current and the time constant ($C_2R_2$); in general, it is necessary to adjust $C_2$ to about a fraction of to about 1/10 of the electric capacity ($C_1$) of the recording layer. As the capacity ($C_1$) of the recording layer becomes large, the quantity of the accumulated charges increases and a high print density can be obtained by the recording operation.

(2) $\tau$(time constant of the undercoat layer) < Wp (width of each pulse applied to the pin electrode):

As described in requirement (1) above, if the electric capacity $C_2$ of the undercoat layer is controlled to a low level, the quantity of the latent image forming current generated by one discharge is reduced; hence, the quantity of charges stored in the recording layer due to one discharge is small. Accordingly, in order to form an appropriate latent image and to obtain a high print density, it is necessary to repeat electric discharge operation for several times. The rising time of the gap voltage from application of a pulsating voltage to the pin electrode and the rising time of the gap voltage from completion of one discharge are defined by the time constant ($\tau = \epsilon_0 \epsilon r_2 \rho_2$) which is determined by the electric capacity ($C_2$) and the resistance ($R_2$) of the undercoat layer. In order to repeat the discharge several times, a relation of $\tau$ < Wp should be established between this time constant and the pulse width (Wp) of the voltage applied to the pin electrode. Especially when an electric discharge is repeated n times, a relation of $\tau$ < Wp/n should be established.

A specific example of this embodiment will now be described.

A layer having a medium electric resistance, namely a resistivity of $10^7\Omega$-cm and a specific inductivity of 4.0, is coated in a thickness of 50 micrometers as an undercoat layer 1*b* on a conductive substrate 1*a*, and a highly resistant layer having a resistivity of $10^{14}\Omega$-cm and a specific inductivity of 7.0 is further coated in a thickness of 20 micrometers as a recording layer 1*c* on the undercoat layer 1*b*. Electric characteristics of the so formed latent image forming material are as follows:

Electric capacity ($C_1$) of the recording layer: 310 pF/cm$^2$

Electric capacity ($C_2$) of the undercoat layer: 70 pF/cm$^2$

Time constant ($\tau$) of the undercoat layer: 3.5 microseconds ($\mu$s)

By using this latent image forming material, a driving voltage having a pulse width of 20 $\mu$s is applied to the pin electrodes to form a latent image, and this latent image is developed with a toner. As a result, a good print free of spots is obtained.

Figure 18:
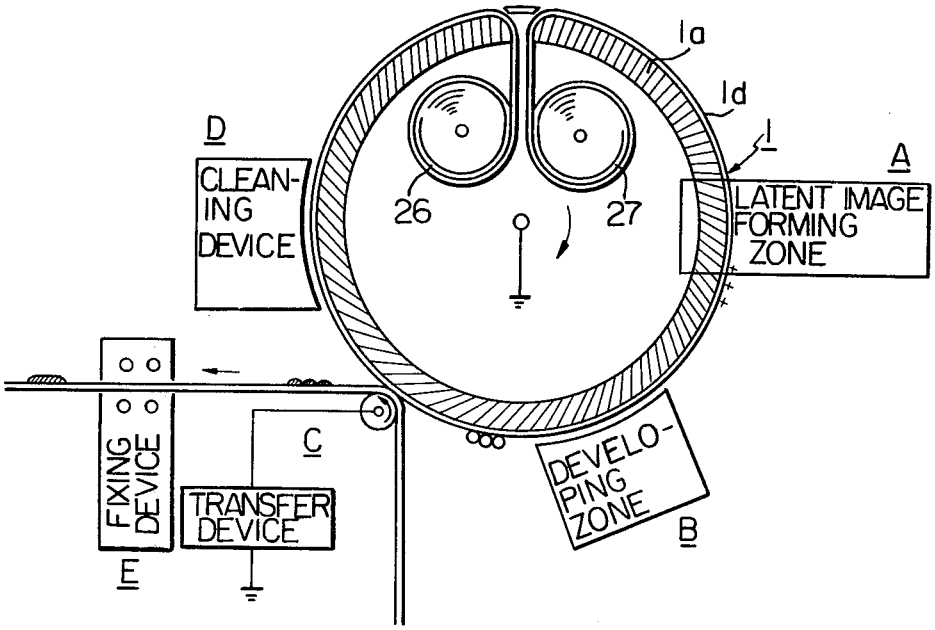
FIG. 18 is a side view of a still another example of the latent image forming material applicable to the electrostatic transfer apparatus of the present invention.

FIG. 18 illustrates another embodiment of the latent image forming material according to the present invention.

Figure 19:
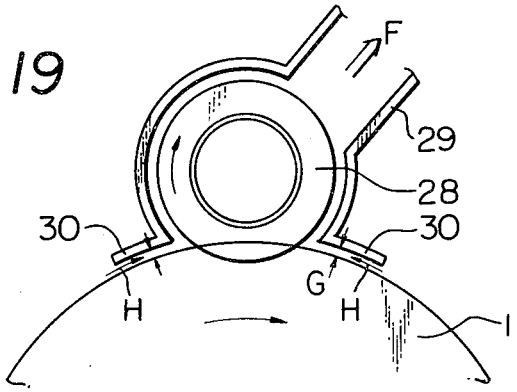
FIG. 19 is a schematic side view of one embodiment of the residual toner removing device according to the present invention.

As is seen from FIG. 19, the latent image forming material 1 of this embodiment is characterized in that a recording paper 1*d* including an insulating layer and a conductive base layer is applied to a conductive substrate 1*a* so that the conductive base layer of the recording paper 1*d* is closely contacted with the conductive substrate 1*a*. Formed on the periphery of this latent image forming material are an electrostatic latent image forming zone A, a developing zone B, a transfer zone C, a cleaning zone d and a fixing zone E as in the embodiment illustrated in FIG. 1. By using this latent image forming material, the printing or recording process is conducted in the same manner as described hereinbefore with reference to FIG. 1, although the present embodiment is different from the embodiment shown in FIG. 1 in the point that a feed roll 26 for feeding out the electrostatic recording paper 1*d* and a recovery roll 27 for winding the electrostatic recording paper are disposed in the interior of the latent image forming material 1.

In this embodiment, when the printing process is repeated continuously or after the printing process has been conducted for a certain time, the electrostatic recording paper 1*d* applied to the periphery of the conductive substrate 1*a* is wound up by the recovery roll 27 and a fresh electrostatic recording paper is fed out instead by the feed roll 26; then, the printing process is started again. Accordingly to this embodiment, a great number of latent images can be formed and kept on the latent image forming material only by winding the electrostatic recording paper; therefore, the printing operation and the manufacture of the apparatus can be facilitated and the running and manufacturing costs can be remarkably lowered.

FIG. 19 illustrates one embodiment of the residual toner removing device to be disposed in the cleaning zone D as shown in FIG. 1.

More specifically, FIG. 19 illustrates one embodiment of the residual toner removing device for removing the toner stuck to the surface of the latent image forming material 1 by means of a fur brush 28 after the transfer step. The device of this embodiment is characterized in that a skirt 30 is attached to the end portion of an opening of a housing 29 surrounding the fur brush 28 at a part facing the latent image forming material 1. When the skirt 30 is thus formed on the front and rear edges of the opening of the housing 29 along the curved surface of the latent image forming material 1, the length of the generated suction air stream H can be elongated as much as possible and the area hindering leakage of the toner outside the housing 29 can be increased, whereby the toner can be confined in the housing effectively. In the drawing, the arrow F indicates the direction of the exhaust air stream which extends to the toner recovery system. Furthermore, G in the drawing represents the length of the gap between the skirt 30 and the curved surface of the electrostatic image forming material 1. When the speed of air (static pressure) and the quantity of air are well balanced by appropriately adjusting the gap length G and the length of the skirt 30, confinement and recovery of the toner can be accomplished at hig efficiency.

Figure 20:
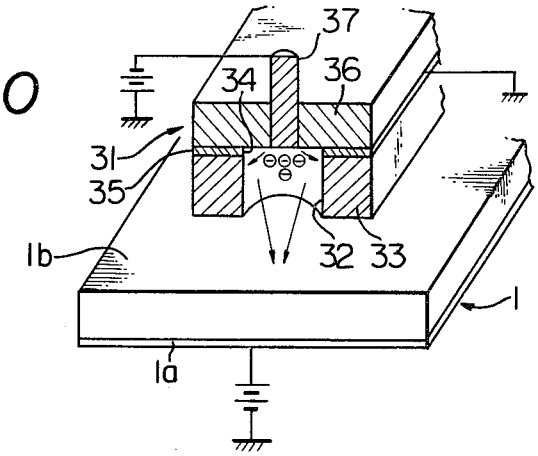
FIG. 20 is a partial perspective view of a still another embodiment of the latent image forming material according to the present invention.

FIG. 20 illustrates another embodiment of the latent image forming apparatus to be disposed in the latent image forming zone A shown in FIG. 1.

An electrostatic latent image is formed of dots by utilizing ions generated by a discharge under application of a voltage, and in the process shown in FIG. 1 where a pin electrode is used for the recording head and an electric discharge is effected directly between the pin electrode and recording surface, the dot diameter is increased as the gap between the pin electrode and the recording surface is increased. Accordingly, in order to stably obtain a good latent image, it is necessary to adjust the gap to 20 to 30 micrometers with high accuracy, but this adjustment is very difficult from the technical veiwpoint. In this embodiment, a constant electric discharge is always stably effected on the recording head and ions generated by this discharge are caused to adhere to the recording surface, so that the gap between the recording head and the recording surface may be broadened and the accuracy required for the gap adjustment may be moderated.

In this embodiment, as shown in FIG. 20, a recording head 31 is disposed at a point separated by 100 micrometers from the surface of a dielectric layer 1*b* forming the surface layer of the image forming material 1 so that the recording head 31 faces the surface of the dielectric 1*b*. Accelerated voltages are applied to the conductive substrate 1*a* located on the opposite side of the dielectric layer 1*b*, so that ions generated by discharge are accelerated and caused to adhere to the surface of the dielectric layer 1*b*.

The recording head 31 comprises an insulator 33 for an electrostatic focusing lens, which has holes 32, a plate electrode 35 having holes 34 which are the same as the holes 32 of the insulator 33, which is piled on the insulator 33, an insulator 36 piled on this electrode 35 and rod electrodes 37 embedded coaxially with the holes 32 and 34. When a negative voltage is applied to the rod electrodes 37 at the latent image forming step, a spark discharge is caused between the electrode 35 and the rod electrodes 37 in the foregoing holes, and certain negative ions are always generated stably. By the electrostatic focusing action of the holes 32 of the insulator 33, the so generated ions are controlled so that expansion of the dot diameter can be prevented and, in this state, the ions are caused to adhere to the surface of the dielectric layer 1*b*. As a result, a desired latent image is formed on the surface of the dielectric layer 1*b*.

Figure 21:
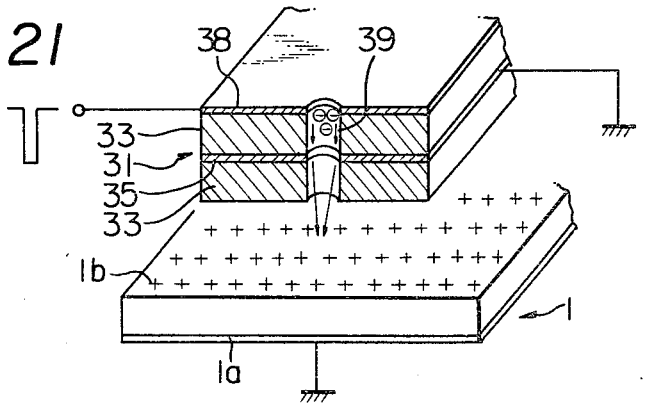
FIG. 21 is a partial perspective view of a further embodiment of the latent image forming material according to the present invention.

FIG. 21 is a diagram illustrating a modification of the latent image forming apparatus shown in FIG. 20.

As shown in FIG. 21, the recording head 31 used in this modification has a four-layer structure in which one insulator 33 is disposed between two plate electrodes 35 and 38 and another insulator 33 is disposed below the plate electrode 35, and holes 39 piercing through these layers are formed.

For example, two copper sheets having a thickness of 35 micrometers are used as the upper and lower plate electrodes 35 and 38, and they are bonded to both the surfaces of an insulating film of polyethylene terephthalate or the like having a thickness of 25 micrometers, respectively, by using an epoxy type adhesive. Then, another insulating film having a thickness of 300 micrometers is bonded to the lower plate electrode. Then, holes 39 are formed by drilling.

Formation of a latent image on the surface of the dielectric layer 1*b* in this embodiment is performed according to the following procedures.

As illustrated hereinbefore with reference to FIG. 1, the surface of the dielectric layer 1*b* is positively charged uniformly by a charging device (not shown) and the conductor 1*a* is earthed. In this state, the lower electrode 35 is earthed by a negative pulsating voltage higher than the threshold discharge voltage is applied to the upper electrode 38. At this point, because of the voltage difference between the two electrodes 35 and 38, a spark discharge is caused between the two electrodes 35 and 38 in the holes 39 to generate negative ions in the vicinity of the upper electrode 38. The so generated negative ions are accelerated and attracted by positive charges accumulated on the surface of the dielectric layer 1*b*. While the negative ions pass through the holes 30 of the lower insulator 33, they are electrostatically focused. Accordingly, these ions are caused to adhere to the surface of the dielectric layer 1*b* in the state where expansion of the dot diameter is thus controlled. As a result, the positive charges on the surface of the dielectric layer 1b are erased by these negative ions to form a latent image.

As will be apparent from the foregoing illustration, the structure of the latent image forming apparatus of this embodiment is very simple and the manufacturing thereof can be remarkably facilitated. Accordingly, the manufacturing cost can be reduced. Furthermore, this embodiment is advantageous over the embodiment illustrated in FIG. 20 in the point that since the holes 39 pierce through the entire structure of the recording head 31, jamming of the holes 39 caused by the toner can easily be prevented by blowing air into these holes 39 from the upper openings thereof.

The electrostatic transfer system of the present invention is especially effective for obtaining multi-color prints.

More specifically, a plurality of visible image forming means, namely developing devices, containing developers of different colors, respectively, are disposed in the developing zone B shown in FIG. 1. After a latant image is electrostatically formed in the electrostatic latent image forming zone A, the above-mentioned developing devices are selectively operated independently to obtain a multi-color toner image having specific areas developed with toners of desired colors, respectively. For selectively operating these developing devices, there is preferably adopted a process in which the magnetic brush developing method is adopted and the developing bias voltage to be applied to the magnetic brush is appropriately controlled. This process will now be described.

Referring to FIG. 3, in the case where the area other than the latent image area 13 to be visualized is maintained at a high voltage (+Vs), the latent image area 13 is maintained at a low voltage (0 volt) and a toner of the same polarity as that of the high voltage (+Vs) is applied to the latent image area 13, if it is intended to attain a state in which toner cannot be applied, namely a state in which development is impossible, this can readily be accomplished by setting the developing bias voltage ($+V_B$) shown in FIG. 6 substantially at zero (0 volt); and if it is intended to allow adherence of the toner, this can be accomplished by setting the developing bias voltage ($+V_B$) at a level higher than 0 volt but slightly lower than +Vs.

What is claimed is:

1. An electrostatic transfer process for performing an electrostatic printing of an image onto a recording paper comprising the steps of:

applying a uniform level of electrostatic charges of a predetermined polarity onto an insulating layer surface of an electrostatic latent image forming material comprised of a conductive substrate and an insulating layer on the conductive substrate;

causing a reduction in the level of electrostatic charges applied to image forming areas of the insulating layer surface wherein an electrostatic latent image corresponding to said image to be printed is formed;

passing said electrostatic latent image forming material past a developing electrode means to which an electric voltage having the same polarity as that of said electrostatic charges applied onto said insulating layer surface of said electrostatic latent image forming material is impressed;

supplying said insulating layer surface of said electrostatic latent image forming material with a developer carrying thereon electrostatic charges of the same polarity as that of said electric voltage impressed to said developing electrode means while said electrostatic latent image forming material is passing by said developing electrode means, thereby allowing said developer to adhere to said image forming areas of said insulating layer surface wherein the level of electrostatic charges is reduced, so that said electrostatic latent image is visualized by said developer, and;

transferring said visualized electrostatic latent image of said electrostatic latent image forming material onto said recording paper.

2. An electrostatic transfer process according to claim 1, wherein the step of causing a reduction in the level of electrostatic charges applied to said image forming areas comprises removing said electrostatic charges from said image forming areas of said insulating layer surface of said electrostatic latent image forming material.

3. An electrostatic transfer process according to claim 1, wherein the step of causing a reduction in the level of electrostatic charges applied to said image forming areas comprises causing a plurality of electric discharges between said electrostatic latent image forming material and pin electrode means arranged adjacent to said insulating layer surface of said electrostatic latent image forming material while said pin electrode means is impressed with electric pulsating voltages related to said image to be printed.

4. An electrostatic transfer process according to claim 1, wherein the step of causing a reduction in the level of electrostatic charges applied to said image forming areas of said electrostatic latent image forming material comprises causing electric discharges between said electrostatic latent image forming material and pin electrode means separated from said insulating layer surface by a predetermined small gap while said pin electrode means is supplied with an electric voltage, said electric voltage being adjusted so as to produce a gas discharging electric field between said pin electrode means and said uniformly charged insulating layer surface and to prevent said electric discharge from continuing to occur after completion of said reduction in the level of said electrostatic charges.

5. An electrostatic transfer process according to claim 1, wherein said electric voltage impressed to said developing electrode means is adjusted to be smaller than a voltage level of said electrostatic charges applied onto said insulating layer surface of said electrostatic latent image forming material.

6. An electrostatic transfer process according to claim 1, wherein the step of causing a reduction in the level of electrostatic charges applied to said image forming areas of said electrostatic latent image forming material comprises supplying said insulating layer surface of said electrostatic latent image forming material with ions which are generated by a recording head means comprising two separate electrodes and an insulator disposed between said two separate electrodes, said recording head means being formed with a hole which pierces said insulator and being supplied with an electric voltage for producing electric discharges between said two separate electrodes through said hole.

7. An electrostatic transfer process according to claim 1, wherein the step of causing a reduction in the level of electrostatic charges applied to said image forming areas of said electrostatic latent image forming material comprises supplying electrostatically, onto said insulating layer surface of said electrostatic latent image forming material, ions which are generated by a recording head means comprising two plate-like electrodes and two insulators which are alternately arranged in a stack, said recording head means being formed with a through-hole piercing said electrodes and insulators, and being supplied with an electric voltage for producing electric discharges between said two separate electrodes through said through-hole.

8. An electrostatic transfer process according to claim 7, wherein said recording head means is supplied with an air flow which flows through said through-hole for preventing jamming of said through-hole while said electric discharges are being produced.

9. An electrostatic transfer apparatus adapted for being incorporated in an electrostatic recording apparatus, comprising:

an electrostatic latent image forming material comprised of a conductive substrate and an insulating layer formed on a surface of the conductive substrate;

means for moving said electrostatic latent image forming material along a predetermined moving path;

an electrostatic latent image forming zone arranged at a first predetermined fixed position adjacent to said predetermined moving path of said electrostatic latent image forming material, said electrostatic latent image forming zone comprising a first means for applying distributed electrostatic charges of a predetermined polarity uniformly onto a surface of said insulating layer of said electrostatic latent image forming material, and a second means for one of either the removing or diminishing of only the electrostatic charges that are applied by said first means to a plurality of electrostatic image forming areas of said insulating layer surface of said electrostatic latent image forming material, said second means being spaced apart from said first means adjacent to said predetermined moving path and in the direction of movement of said electrostatic latent image forming material;

a developing zone arranged at a second fixed position adjacent to said predetermined moving path of said electrostatic latent image forming material, said developing zone comprising a developing electrode to which an electric voltage having the same polarity as that of said electrostatic charges applied onto said insulating layer surface is impressed, and a developer supply means for supplying said insulating layer surface with a developer carrying thereon electrostatic charges of the same polarity as that of said electric voltage impressed to said developing electrode, whereby said developer supplied by said developer supplying means electrostatically adheres to only said electrostatic image forming areas of said electrostatic latent image forming material to thereby produce a visualized image to be printed;

a transfer zone arranged at a third predetermined fixed position adjacent to said predetermined moving path of said electrostatic latent image forming material, said transfer zone comprising means for transferring said visualized image to a recording paper supplied toward said transfer zone, and;

a fixing zone comprising means for fixing said image transferred by said transfer zone onto said recording paper.

10. An electrostatic transfer apparatus according to claim 9, wherein said second means of said electrostatic latent image forming zone comprises an electrode means which is impressed with pulsating electric voltages having a polarity opposite to that of said electrostatic charges applied onto said insulating layer surface of said electrostatic latent image forming material, said pulsating electric voltages producing electric discharges between said electrode means and said insulating layer surface so that only said electrostatic charges applied to said electrostatic image forming areas are removed or diminished.

11. An electrostatic transfer apparatus according to claim 10, wherein said insulating layer of said electrostatic latent image forming material comprises a first dielectric layer formed on said conductive substrate, said first dielectric layer having a low level of electric capacity and a medium level of electric resistance, and a second dielectric layer formed on said first dielectric layer, said second dielectric layer having an electric capacity larger than said electric capacity of said first dielectric layer.

12. An electrostatic transfer apparatus according to claim 11, wherein said electric capacity and electric resistance of said first dielectric layer are selected so as to establish a time constant having a magnitude smaller than that of a time interval during which each of said pulsating electric voltages is impressed to said electrode means of said second means.

13. An electrostatic transfer apparatus according to claim 9, wherein said insulating layer of said electrostatic latent image forming material comprises an electrostatic recording paper having an external surface coated with an electric insulating film layer and a back surface coated with a conductive film layer closely contacting said conductive substrate of said electrostatic latent image forming material.

14. An electrostatic transfer apparatus according to claim 13, further comprising means for shifting said electrostatic recording paper with respect to said conductive substrate of said electrostatic latent image forming material.

15. An electrostatic transfer apparatus according to claim 9, wherein said second means of said electrostatic latent image forming zone comprises a recording head comprising two separate electrodes and an insulator disposed between said two separate electrodes, said insulator being formed with a hole through which electric discharges are produced when an electric voltage is applied between said two separate electrodes.

16. An electrostatic transfer apparatus according to claim 9, wherein said second means of said electrostatic latent image forming zone comprises a recording head comprising two plate-like electrodes and two insulators which are alternately arranged in a stack, said recording head being formed with a through-hole piercing said electrodes and insulators.

* * * * *

UNITED STATES PATENT AND TRADEMARK OFFICE

CERTIFICATE OF CORRECTION

PATENT NO. : 4,137,537

DATED : January 30, 1979

INVENTOR(S) : HIDEO TAKAHASHI et al

It is certified that error appears in the above-identified patent and that said Letters Patent are hereby corrected as shown below:

The heading "BACKGROUND OF THE INVENTION" should be inserted on line 4 of column 1.
Column 2, line 28, "A still" should be --Still--.
Column 4, line 34, "these" should be --this--.
Column 6, line 60, "VB" should be --$V_B$--.
Column 9, line 63, "resistitity" should be --resistivity--.
Column 10, line 49, "time" should be --times--.
Column 12, line 55, "Fig.19" should be --Fig. 18--.
Column 13, line 49, "hig" should be --high--.
Column 14, line 54, "by" should be --and--.

Fig. 5, the ordinate, the unit--MLI GRAM/CENTIMETER$^2$--should be inserted.
Fig. 7, the abscissa, the unit "METER/VOLT" should be --METER/MINUTE--.
Fig. 8, the abscissa, the unit --VOLT--should be inserted.

Signed and Sealed this

*Seventeenth* Day of *July 1979*

[SEAL]

*Attest:*

*Attesting Officer*

LUTRELLE F. PARKER

*Acting Commissioner of Patents and Trademarks*